United States Patent [19]

Monks

[11] 3,999,488

[45] Dec. 28, 1976

[54] GRIPPING DRIVERS LOCOMOTIVE

[75] Inventor: Harry Monks, Burton-on-Trent, England

[73] Assignee: Coal Industry (Patents) Limited, London, England

[22] Filed: Feb. 28, 1975

[21] Appl. No.: 554,202

[30] Foreign Application Priority Data

Mar. 7, 1974 United Kingdom ..... 10215/74

[52] U.S. Cl. ..... 105/30; 104/248; 105/29 R; 105/145

[51] Int. Cl.[2] ..... B61B 13/06; B61B 13/12; B61C 11/00; B61C 13/02

[58] Field of Search ..... 105/29 R, 30, 145; 104/248

[56] References Cited

UNITED STATES PATENTS

| | | | |
|---|---|---|---|
| 131,839 | 10/1872 | Baker | 105/30 X |
| 891,882 | 6/1908 | Valentine | 105/30 |
| 1,102,615 | 7/1914 | Valentine | 105/30 |

*Primary Examiner*—L. J. Paperner
*Assistant Examiner*—Howard Beltran
*Attorney, Agent, or Firm*—Stevens, Davis, Miller & Mosher

[57] ABSTRACT

Haulage equipment for hauling a mining machine or vehicle along a stationary elongated rail assembly having a generally wedge shaped cross-sectional area comprising a body rotatably supporting two pairs of drivably interconnected rollers, the axes of the rollers in each pair being inclined to one another such that the rollers are arranged for drivable engagement with two opposed acutely related inclined faces of the rail assembly.

5 Claims, 5 Drawing Figures

GRIPPING DRIVERS LOCOMOTIVE

This invention relates to haulage equipment for hauling machines or vehicles along predetermined paths.

In particular, although not exclusively, the invention relates to haulage equipment for hauling a mining machine to and fro along a longwall face. A known form of such mining haulage equipment comprises a train of sprockets mounted on the machine and a chain drivably engaging the train of sprockets and drivably engagable with a track arranged along the length of the longwall face so that in use when the train of sprockets is driven the machine hauls itself along the track and, therefore, along the longwall face. Unfortunately, such known haulage equipment requires that the chain and track must be manufactured to a high degree of tolerance in order that the chain correctly engages the track. Thus such known haulage equipment tends to be expensive.

Another known form of such haulage equipment comprises a driven sprocket mounted on the machine body and a chain extending along the length of the longwall face. Although such haulage equipment is relatively inexpensive it suffers from the disadvantage that a long length of relative weak chain is required which is liable to break if the machine becomes fast during its traverse along the working face and which tends to whip dangerously.

An object of the present invention is to provide haulage equipment which overcomes or reduces the above mentioned disadvantages.

According to the present invention haulage equipment for hauling a machine or vehicle along a stationary elongated rail assembly having a generally wedge shaped cross-sectional area comprises a body rotatably supporting at least a pair of rollers, at least one of the rollers being drivable, the axes of the rollers being inclined to one another such that the rollers are arranged for drivable engagement with two opposed inclined faces of the wedged shaped rail assembly.

Preferably, the pair of rollers are drivably interconnected.

Advantageously, the equipment comprises two pairs of rollers and in which case all four rollers are drivably interconnected.

Conveniently, the body is arranged to extend at least partially beneath the base of the wedge shaped rail for captivating the equipment to the rail.

Two embodiments of the present invention will be described with reference to the accompanying drawings in which.

Figure 1:
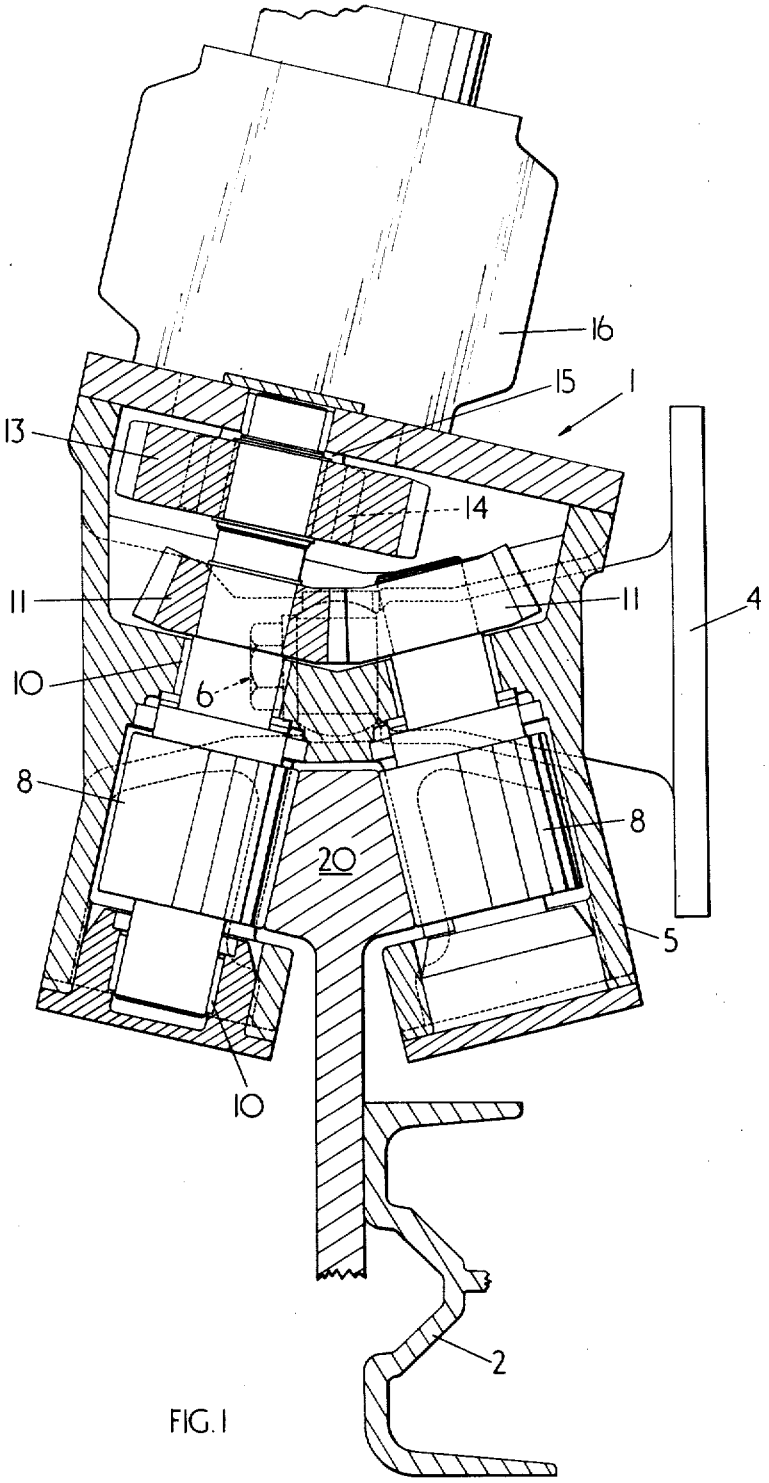
FIG. 1 is a sectional front view of a first embodiment of mining haulage equipment constructed in accordance with the present invention and shown in an operational position.
Figure 2:
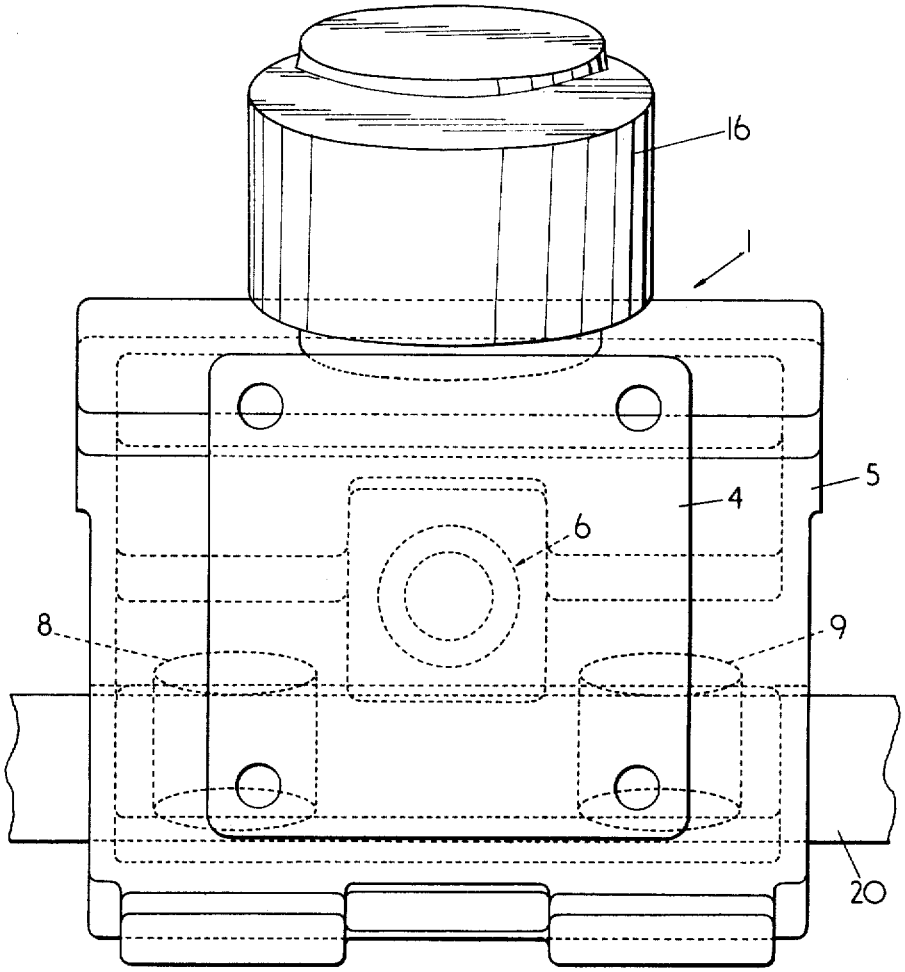
FIG. 2 is a side view of the equipment of FIG. 1.
Figure 3:
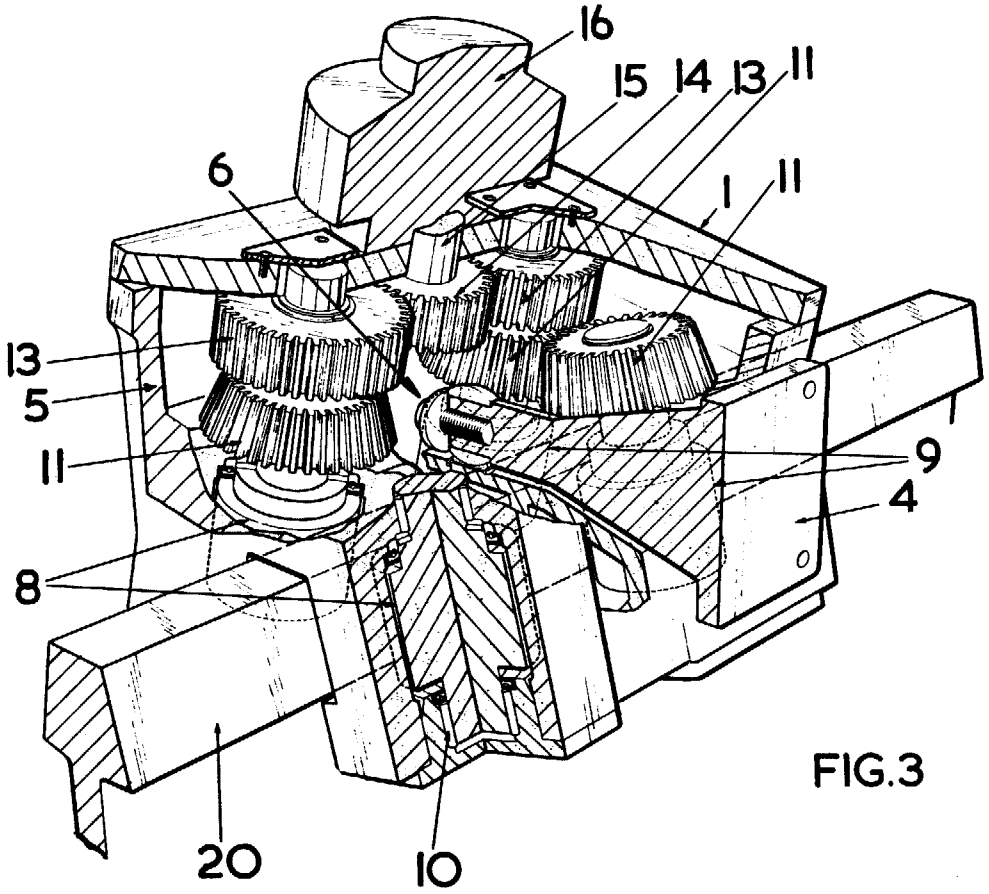
FIG. 3 is a perspective view, partly in section, of the equipment of FIG. 1.

Referring to FIGS. 1 to 3 of the drawings, the first embodiment of mining haulage equipment 1 is for hauling a coal mining machine (only a bracket 4 of which is shown) along a longwall coal face. The machine traverses to and fro along an armoured face conveyor (a part of one pan of which is shown at 2 in FIG. 1) and is bolted via the bracket 4 to the equipment 1 by a ball joint connector 6 which allows limited universal movement between the bracket 4 and equipment.

The mining haulage equipment 1 comprises a body 5 supporting the ball joint connector 6 and rotatably supporting two pairs of rollers 8 and 9 mounted on opposite sides of the ball joint connector. Each of the rollers is carried in bearings 10 and is fixedly secured to a gear wheel 11. The gear wheels 11 of each pair of rollers drivably engage each other. One roller of each pair of rollers 8 and 9 is fixedly secured to a further gear wheel 13 which drivably engages a central gear wheel 14 fixedly secured on a shaft 15 of a motor 16 mounted on the body 5. The arrangement is such that the motor drives all four rollers via the common gear wheel 14 and the two trains of gear wheels 13 and 11.

The axes of the rollers in each pair are vertically inclined with respect to one another so that the rollers of each pair drivably engage two opposed inclined surfaces of a stationary elongated rail 20 of generally wedge shaped cross section. The rail is secured to the adjacent conveyor pan 2 and is one of a series of aligned rails constituting an elongated track extending along the coal face.

The body 5 of the equipment extends partially beneath the base of the wedge shaped rail 20 to captivate the equipment to the rail.

In operation, the mining equipment is secured to the mining machine via brackets 4 so that at least a portion of the weight of the machine is carried by the equipment 1. Thus, when the motor 16 is actuated to rotate the rollers the machine is hauled along the rail 20, the weight of the machine carried by the equipment tends to urge the equipment down onto the rail and thereby tends to prevent the rollers slipping and maintains drivable engagement between the rollers and the opposed faces of the rail.

The mining haulage equipment has the advantage that as the rail 20 or rollers wear, the ball joint connector permits the equipment to move freely downwards to maintain double engagement between the rollers and the opposed faces of the rail.

In alternative embodiments of the mining equipment only one of the rollers of each pair is driven.

In further alternative embodiments of the invention the rail is supported adjacent to the mine roof and the machine or vehicle is suspended below the rail. In such embodiments the body of the mining haulage equipment may be arranged beneath the rail.

Figure 4:
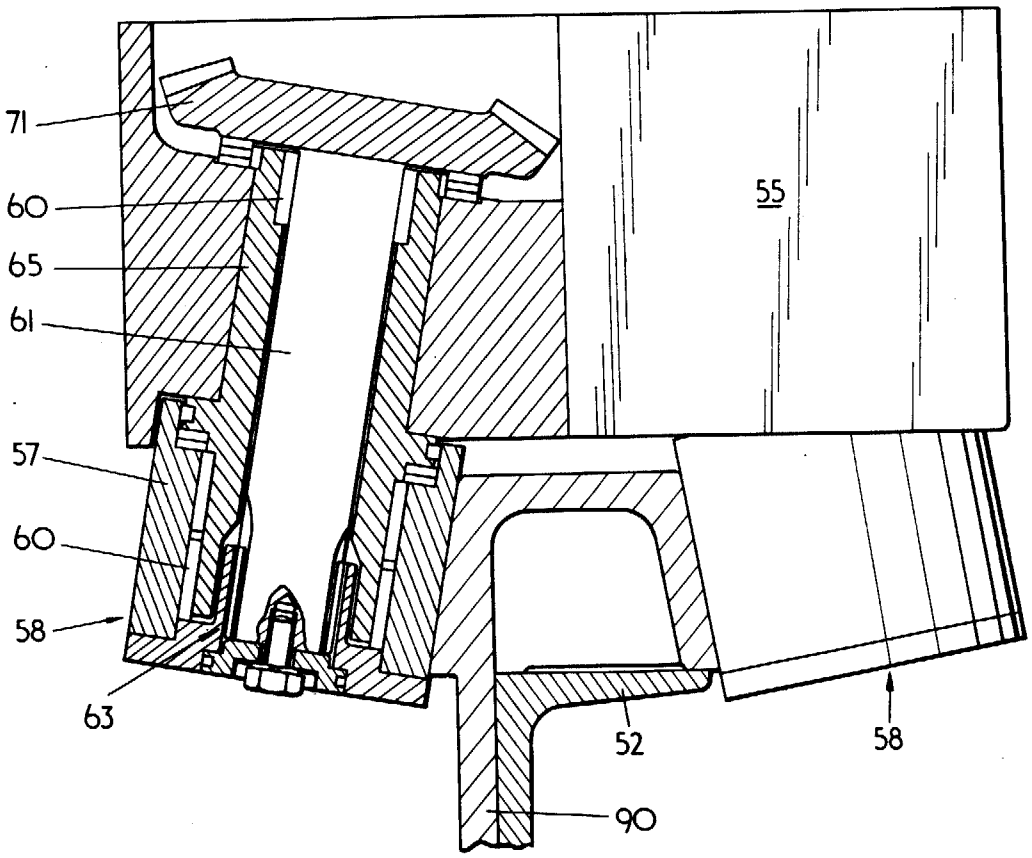
FIG. 4 is a sectional front view of a second embodiment of mining haulage equipment constructed in accordance with the present invention.
Figure 5:
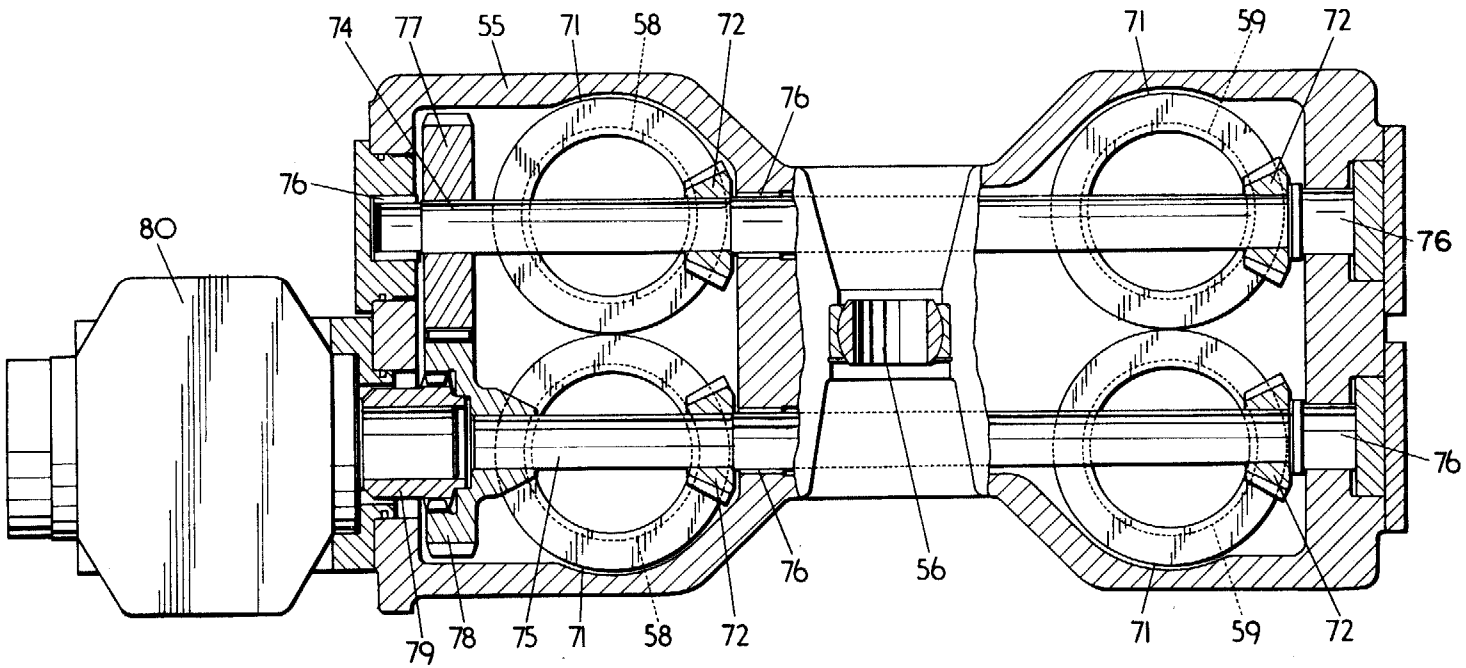
FIG. 5 is a sectional plan of the equipment of FIG. 4.

Referring now to FIGS. 4 and 5 of the drawings the second embodiment of mining haulage equipment is for hauling a coal mining machine (not shown) along a longwall coal face.

As with the first described embodiment the machine traverses to and fro along an armoured face conveyor (a part of one pan of which is shown at 52 in FIG. 4) and is bolted to the mining haulage equipment via a ball joint connector 56 which allows limited universal movement between the machine and the haulage equipment.

The second embodiment of mining haulage equipment comprises a body 55 supporting the ball joint connector 56 and rotatably supporting two pairs of downwardly projecting rollers 58 and 59 mounted on opposite sides of the ball joint connector. Each of the rollers comprises an outer cylindrical member 57 and a central drive shaft 61 which is drivably connected via co-operating splines 63 to the member 57 and which is carried in bearings 60 housed within a sleeve 65. Each of the drive shafts 61 is fixedly secured to a dished gear wheel 71 which drivably engages one of a pair of bevelled gear wheels 72 mounted on parallel drive shafts 74, 75 which are carried in bearings 76 housed within the body 55 and which are drivably interconnected by a train of engaging gear wheels 77, 78 and 79, the gear wheels 77 and 78 are drivably connected to the shafts 74 and 75 respectively, and the gear wheel 79 drivably engages a shaft of a motor 80 mounted outboard on the body 55. (The motor is not shown in FIG. 4).

As with the first embodiment the axes of the rollers in each pair are vertically inclined with respect to one another so that the rollers of each pair drivably engage two opposed inclined surfaces of a stationary elongated rail assembly 90 of generally wedge shaped cross section. The rail is secured to the adjacent conveyor pan 52 and is one of a series of aligned rails constituting an elongated track extending along the coal face.

As will be seen in FIG. 4 the body 55 is arranged over the rail which is engaged by the downwardly and outwardly projecting rollers.

The second embodiment of mining haulage equipment operates in similar manner to that previously described with reference to the first embodiment. However, the second embodiment is a more compact design enabling the haulage equipment to be used in installations where height restrictions occur.

I claim:

1. Haulage equipment mounted for travel along a stationary elongated rail assembly having a generally wedge shaped cross-sectional area with two opposed inclined faces which are at an acute angle to each other, said haulage equipment being adapted for moving a vehicle along the track assembly and comprising a body, means on the body for connecting the equipment to the vehicle including a ball joint connector to allow limited universal movement between the body and the vehicle, at least a pair of rollers rotatably supported by the body, at least one of the rollers of the pair being drivable, the axes of the rollers in the pair being inclined to one another such that the rollers engage the inclined faces of the rail, the rollers being urged into contact with the rail by the weight of the haulage equipment and a portion of the weight of the vehicle.

2. Equipment as claimed in claim 1, in which there are two pairs of rollers rotatably supported by the body with the ball joint connector being intermediate the two pairs of rollers and above the rail.

3. Equipment as claimed in claim 2, in which all the rollers are drivably interconnected.

4. Equipment as claimed in claim 3, in which the body is arranged to extend at least partially beneath the base of the wedge shaped rail assembly for captivating the equipment to the rail assembly.

5. Haulage equipment for a mine mounted for travel along a stationary elongated rail assembly having a generally wedge shaped cross-sectional area with two opposed inclined faces which are at an acute angle to each other, said haulage equipment being adapted for moving a mining vehicle along the track assembly and comprising a body, means on the body for connecting the equipment to the vehicle including a bracket and a ball joint connector to allow limited universal movement between the body and the bracket, at least two pairs of rollers rotatably supported by the body, at least one of the rollers being drivable, the ball joint connector being between the two pairs of rollers and above the rail, the axes of the rollers of each pair being inclined to one another such that the rollers engage the inclined faces of the rail, the rollers being urged into contact with the rail by the weight of the haulage equipment and a portion of the weight of the vehicle.

* * * * *